US006703981B2

(12) United States Patent
Meitzler et al.

(10) Patent No.: US 6,703,981 B2
(45) Date of Patent: Mar. 9, 2004

(54) ANTENNA(S) AND ELECTROCHROMIC SURFACE(S) APPARATUS AND METHOD

(75) Inventors: William Meitzler, Elk Grove Village, IL (US); Paul Vonallmen, Mesa, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/164,330

(22) Filed: Jun. 5, 2002

(65) Prior Publication Data

US 2003/0227416 A1 Dec. 11, 2003

(51) Int. Cl.[7] ..... H01Q 19/10
(52) U.S. Cl. ..... 343/755; 343/909
(58) Field of Search ..... 343/712, 713, 343/755, 753, 909; 359/273, 603, 604; 340/550; 525/540

(56) References Cited

U.S. PATENT DOCUMENTS

| | | | | | |
|---|---|---|---|---|---|
| 5,795,942 | A | * | 8/1998 | Rhee et al. | 525/540 |
| 5,910,854 | A | * | 6/1999 | Varaprasad et al. | 359/273 |
| 6,244,716 | B1 | * | 6/2001 | Steenwyk et al. | 359/603 |
| 6,431,712 | B1 | * | 8/2002 | Turnbull | 359/604 |
| 6,535,126 | B2 | * | 3/2003 | Lin et al. | 340/550 |
| 2002/0126054 | A1 | * | 9/2002 | Fuerst et al. | 343/712 |

* cited by examiner

*Primary Examiner*—Hoang V. Nguyen
(74) *Attorney, Agent, or Firm*—Daniel K. Nichols

(57) ABSTRACT

One or more electrochromic surfaces (11) (formed on rigid or flexible carrier surfaces) are used in various ways with one or more radio frequency energy radiating elements (10) and/or guiding elements (91 and 120) to lend selective reflectivity to achieve greater resultant control over directionality, gain, phase, and/or shape of the radiated energy.

49 Claims, 3 Drawing Sheets

ANTENNA(S) AND ELECTROCHROMIC SURFACE(S) APPARATUS AND METHOD

TECHNICAL FIELD

This invention relates generally to antennas, and more particularly to radio frequency reflective surfaces as used in conjunction therewith.

BACKGROUND

Antennas that radiate radio frequency energy are well known in the art. An unadorned antenna will typically radiate such energy in an omnidirectional fashion. It is also known to shape and/or specifically direct or steer the radiated energy towards (or away from) a particular area. For example, metal reflectors can be used to inhibit such energy from moving in a given direction. In addition, multiple antenna arrays can be manipulated, as with some proposed sectored antenna patterns and as implemented through baseband phasing techniques, to steer, at least to some extent, the radiated energy. Some such steering systems operate wholly electrically (as by phase adjustment and/or by switching various antennas in and out of operational modes), some wholly mechanical (as by rotor driven sector antennas), or combinations of both approaches.

Though suitable for at least some applications, the above solutions are not suitable for all contexts. Further, some of these techniques (and especially the more flexible approaches) are expensive and/or prone to maintenance problems (mechanically based systems utilizing moving mechanical parts are especially subject to these issues). Also, existing techniques, while potentially applicable for generally or specifically directing or blocking a beam of radio frequency energy in a given direction, are generally not useful for control of other potentially important performance parameters, including gain control and beamwidth control. Some combined solutions in this regard, such as use of omnidirectional antennas combined with multiple PIN diode driven scatterers, can effect beam steering and controllable beamwidth but are relatively expensive and further can cause switching spikes that can detrimentally impact system performance.

BRIEF DESCRIPTION OF THE DRAWINGS

The above needs are at least partially met through provision of the antenna(s) and electrochromic surface(s) method and apparatus described in the following detailed description, particularly when studied in conjunction with the drawings, wherein.

Figure 1:
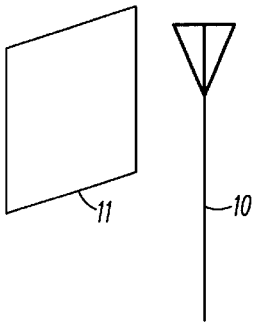
FIG. 1 depicts an antenna and electrochromic surface as configured in accordance with an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are typically not depicted in order to facilitate a less obstructed view of these various embodiments of the present invention. Also, various antenna patterns and/or radio frequency energy emissions and reflections are depicted for purposes of illustration only and are not necessarily meant to accurately depict specific likely angles of reflection or the like.

DETAILED DESCRIPTION

Generally speaking, pursuant to these various embodiments, one or more antennas is used in conjunction with one or more electrochromic surfaces. Through selective energization, these electrochromic surfaces can be rendered partially or substantially wholly opaque to radio frequencies of interest. These electrochromic surfaces are substantially transparent when in the reduced state with a positive bias applied. They are highly conductive in the oxidized state with a negative bias applied. These surfaces require little current for switching and will remain in the same state for hours when no electric current is applied.

In various embodiments, such electrochromic surfaces can be used alone or in conjunction with other such surfaces and/or with other more traditional reflective surfaces to generally or specifically direct a beam of radio frequency towards or away from a desired direction. In addition, multiple phased-controlled antennas can be used with such surfaces to gain yet additional control over the resultant beam of energy.

In one embodiment, the electrochromic surface can be comprised of a doped conjugated polymer, such as polyaniline that is doped with camphorsulfonic acid and wherein the polymer further includes a source of cations such as sodium, potassium, or lithium. In another embodiment, the electrochromic surface can be comprised of an oxide of at least one of tungsten, molybdenum, or niobium in conjunction, again, with a source of cations. Depending upon the particular configuration selected and the conductive material used for the electrodes, the electrochromic surface can be partially or wholly transparent to visible light at least part of the time. Such transparency offers the possibility of antenna structures that are potentially more aesthetically appealing for at least some applications.

Such electrochromic surfaces can also be used to selectively alter the performance of a parabolic antenna feedhorn. For example, such surfaces can be used to allow control over the effective beam width and/or phase taper of such a feedhorn without any mechanical movement. This can facilitate significant operational flexibility with potentially increased operating reliability at reduced cost.

Such electrochromic surfaces can also be used in a waveguide to control ingress and/or egress of radiated energy. Further, such surfaces, being energizable to yield varying levels of transparency and opaqueness at radio frequencies of interest, can be used to allow passage of various levels of energy instead of merely functioning as a prior art shutter in this regard.

Electrochromic technology has primarily been used for modulation of visible light (as exemplified by variable tint windows or mirrors for home, office, and vehicular use) and also for control of infrared radiation to control home and space vehicle heating. In a typical application, a layer of electrochromic material is disposed between two planar electrodes and next to a layer that comprises a source of cations. Upon applying an electrical bias between the two electrodes, the cations migrate into or from the electrochromic material. The electronic structure of the material is thereby modified along with its absorption and reflection characteristics.

As is known in the art, the electrochromic reaction creates both controllable conductivity and controllable light energy absorption. The oxides of tungsten, molybdemum, or niobium are usually used as the electrochromic material. The movement of lithium, potassium, or sodium ions controls the electronic band gap and hence the absorption of light as well as the electric conductivity within the electrochromic material. The band gap energies control light absorption at optical frequencies as well understood in the art. Electrochromic material will typically tint or clear as ions are shuttled back and forth between an electrochromic layer and an ion-storage layer (somewhat akin to two battery electrodes that are separated by an electrolyte), with only a small voltage being required to inject or eject the ions and electrons. Visible spectrum applications typically use $WO_3$ (or $MoO_3$ or $Nb_2O_5$) as the electrochromic material. It is possible that such material will serve a radio frequency application as well, but not presently certain.

Figure 13:
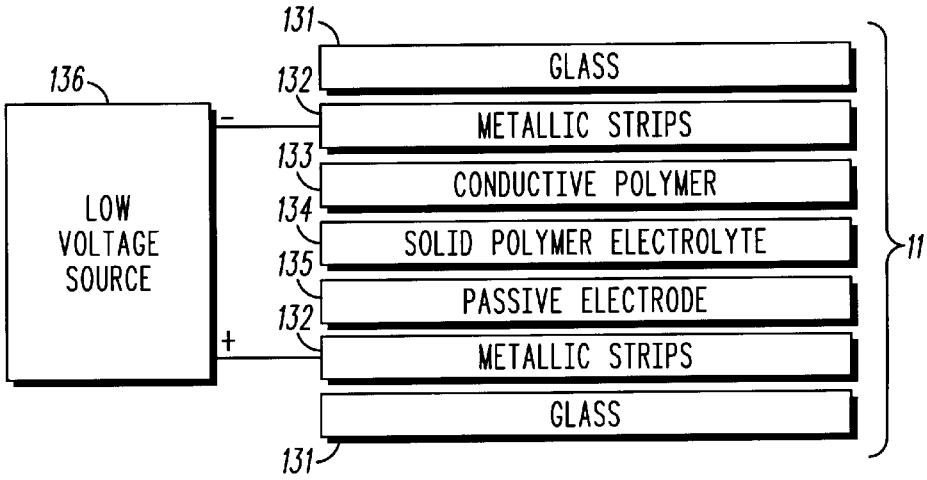
FIG. 13 comprises a side elevational diagramatic view of an electrochromic surface as configured in accordance with an embodiment of the invention.

Polymer materials that are intrinsically conductive can be switched between an insulating and conductive state through electrochemical oxidation and reduction. Polymer materials are used for printed flexible circuits with transistors. They are used at low frequencies for identification tags and anti-theft stickers. Though normally exploited, if at all, for optical purposes (because such changes are often accompanied by significant change in the optical characteristics of the polymer), such materials will also serve a similar purpose at useful radio frequencies. A preferred embodiment therefore utilizes polyaniline as the electrochromic material. In particular, and with reference to FIG. 13, an active electrode comprising a conductive polymer 133 such as polyaniline (which is a conjugated polymer) that has been doped with camphorsulphonic acid is essentially laminated between opposing glass plates 131 and metallic strips 132 (comprised, in this embodiment of substantially parallel stripes of tin oxide) in conjunction with a solid polymer electrolyte 134 and a passive electrode 135 (in this embodiment, lithium) source of cations. The principle of operation remains essentially the same as above. The mechanism leading to a variation in conductivity involves switching between an oxidized and a reduced state of the conductive polymer film 133 using $Li^+$ cations. A low voltage source 136 coupled to the metallic strips 132 controls these reactions.

For applications in the visible spectrum, the cations modify the electronic band gap and therefore the minimum frequency at which light will be absorbed. For radio frequencies, these cations modify the electrical conductivity and therefore the corresponding tendency to transmit or reflect radio frequency radiation. Also, while visible spectrum applications tend towards use of a solid planar ITO layer, radio frequency applications benefit from a geometry that will allow for the transmission of radio frequency energy (for example, by shaping the electrode as stripes of conducting material). The effective degree of opacity and transparency to a given bandwidth of radio frequencies will generally be a function of the polymer type, the dopant, relative thickness of the material, morphology, and conductivity. In a preferred embodiment, an active electrode for an electrochromic surface configured in accordance with the invention is polyaniline conductive polymer film that is capable of reversible electrochemical oxidation/reduction reactions and a passive counter electrode is $LiMn_2O_4$ that permits reversible operation by storing and supplying the mobile counter ions.

Switching times when using lithium in the polyaniline to cause the polyaniline to become conductive tend to be relatively slow (perhaps on the order of ten minutes) though nevertheless suitable for the purposes set forth below. Faster switching times may result when using tungsten oxide instead of polyaniline though use of such a substance may involve a tradeoff for higher resistive power losses internal to the electrochromic plate. Tungsten oxide is presently used in most commercial optical electrochromic embodiments.

An effective electrochromic surface suitable for use at, say, 2 GHz (which frequency has a free space wavelength of 0.150 meters) can have a size that is smaller than an average residential window. This result will benefit applications that can utilize a relatively small reflector surface. For embodiments that require a larger reflective surface, the electrochromic surface can of course be scaled larger. A laminated structure as described above can be fashioned quite thinly. Further, there is no particular reason why the surrounding envelope need be comprised of glass as described. Other rigid materials would serve as well (so long as those materials are substantially transparent to the radio frequencies of interest) or, if desired, nonrigid materials. For example, a thin flexible plastic membrane could be used as a substitute for the glass exterior to provide an electrochromic surface that is, itself, flexible. Such an electrochromic surface could be conformally disposed about a suitable mandrel to thereby provide an electrochromic surface of desired configuration.

Figure 2:
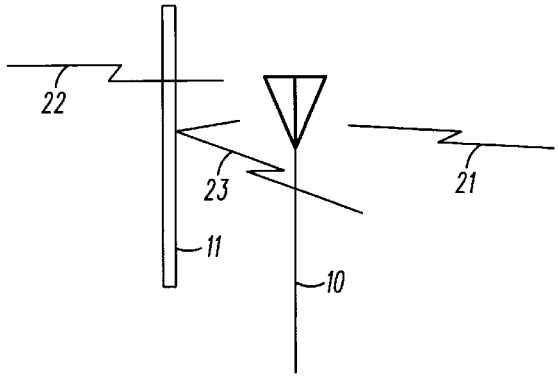
FIG. 2 illustrates potential radio frequency energy behavior as can result in accordance with an embodiment of the invention.

There are a variety of ways in which such electrochromic surfaces can be used to useful effect with one or more antennas. In general, by placing such a surface 11 near a dipole antenna 10 (as shown in FIG. 1), the corresponding radiation pattern for the antenna 10 can be selectively impacted. For example, and with reference to FIG. 2, radio frequency waves 21 as emitted by the antenna 10 away from the electrochromic surface 11 in the first instance will travel unimpeded. And, when the electrochromic surface 11 is powered down to a substantially transparent state, radio frequency waves 22 as emitted by the antenna 10 towards the electrochromic surface 11 will also travel unimpeded through the electrochromic surface 11 and beyond. When, however, the electrochromic surface 11 is powered to cause the electrochromic surface 11 to become at least partially opaque to the radio frequency waves, some of the radio frequency waves 23 will be reflected away from the electrochromic surface 11. By variable control of the energization of the electrochromic surface 11, the opacity of the electrochromic surface 11 can be selectively controlled and hence the amount of energy that is passed through the electrochromic surface 11 and that is reflected away therefrom. A simple configuration such as that depicted in FIGS. 1 and 2 can be used, for example, to shield the area behind the electrochromic surface 11 from the energy transmissions of the antenna 10.

Figure 3:
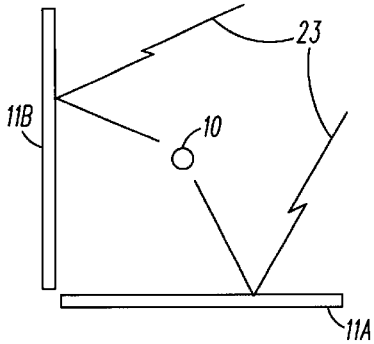
FIG. 3 depicts an alternative embodiment of an antenna and electrochromic surfaces as configured in accordance with an embodiment of the invention.

Referring now to FIG. 3, two electrochromic surfaces 11A and 11B can be used, for example, to form a corner reflector. Such a configuration can be used to both shield the area behind the surfaces 11A and 11B and to effectively direct the bulk of the radiated energy 23 in a desired direction. As shown, both surfaces 11A and 11B are energized and are therefore presenting an opaque surface to the radio frequency emissions of the antenna 10. As may be appropriate to a given application, however, only one surface. 11A or 11B need be energized, such that energy is reflected from one and not the other at any given time. Further, if desired, the degree of opacity and hence the degree of reflection can be selectively varied as well, such that some energy passes through the surface 11A and/or 11B and some energy is diverted away therefrom.

Figure 4:
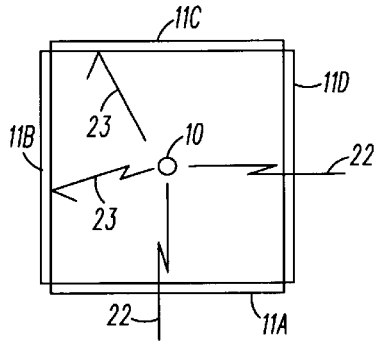
FIG. 4 depicts another alternative embodiment of an antenna and electrochromic surfaces as configured in accordance with an embodiment of the invention.

FIG. 4 depicts another exemplary embodiment wherein the antenna 10 is effectively surrounded by four electrochromic surfaces 11A, 11B, 11C, and 11D. As depicted, two of the surfaces 11B and 11C are substantially opaque such that energy 23 is reflected away therefrom, and two of the surfaces 11A and 11D are substantially transparent such that energy 22 passes therethrough relatively unimpeded. With this configuration, any of the surfaces can be rendered opaque, transparent, or somewhere in between to gain significant control over the emission of radio frequency energy into each of the corresponding quadrants.

Figure 5:
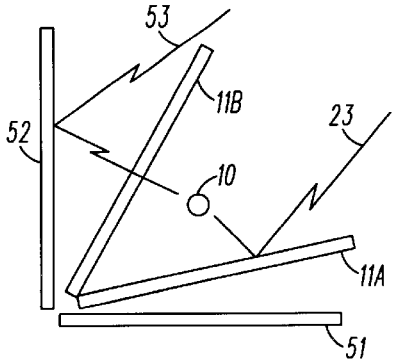
FIG. 5 depicts yet another alternative embodiment of an antenna and electrochromic surfaces as configured in accordance with an embodiment of the invention.

Referring now to FIG. 5, in yet another embodiment one or more electrochromic surfaces 11A and 11B can be used in conjunction with two other reflective surfaces 51 and 52 (wherein the latter reflective surfaces 51 and 52 can be other electrochromic surfaces and/or traditional metal conductors). As configured, the two electrochromic surfaces 11A and 11B form inner potential reflective surfaces as compared to the outer reflective surfaces 51 and 52. When one of the inner surfaces (such as the electrochromic surface 11B) is transparent, radio waves 53 will pass therethrough and subsequently reflect off the corresponding outer reflective surface 52. Conversely, when one of the inner surfaces (such as the electrochromic surface 11A) is opaque, radio waves 23 will be reflected therefrom. This directional and/or shielding control can be used in an appropriate application to particularly direct the radio emissions from the antenna 10 and/or control the beam width of the resultant radiation (additional description regarding beam width control is provided below in conjunction with FIG. 7)

Figure 6:
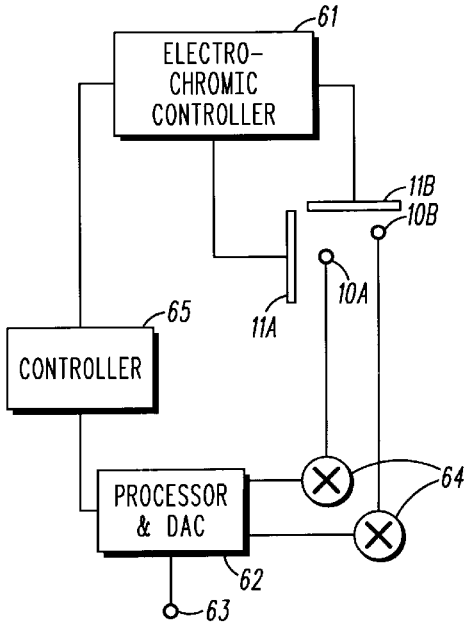
FIG. 6 depicts a block diagram of a system for effecting use of various configurations as configured in accordance with an embodiment of the invention.

The above described embodiments include a single antenna 10. If desired, additional antennas can be included. In particular, phased antenna arrays are well understood in the art, and two or more phase controlled antennas can be used in conjunction with electrochromic surfaces to gain additional directional control over the resultant radio emissions. For example, and referring now to FIG. 6, two antennas 10A and 10B can each be coupled via upband modulators 64 to a processor 62 that includes two digital-to-analog converters used as both modulators and phase shifters as well understood in the art. So configured, relatively high speed beam shaping can be effected with respect to the resultant combined emissions as radiated by the two antennas 10A and 10B. In addition, however, this embodiment further includes two electrochromic surfaces 11A and 11B disposed proximal to the two antennas 10A and 10B. Each of the electrochromic surfaces 11A and 11B are operably coupled to and controlled by an electrochromic controller 61. The latter constitutes a relatively slow speed pattern controller that can significantly contribute to overall shaping of the resultant radio emission beam. In this embodiment, this controller 61 can be simply comprised of the appropriate low voltage sources necessary to energize the electrochromic surfaces 11A and 11B and, in this embodiment, is itself coupled to a controller 65 that also couples to and influences the high speed beam shaping processor 62. So configured, the controller 65 can utilize the electrochromic surfaces 11A and 11B via the electrochromic controller 61 to coarsely direct the resultant beam and the processor 62 to phase adjust elements of an incoming information signal 63 as provided to the two antennas 10A and 10B such that phase adjusting techniques can be utilized to achieve finer, faster, and independent channel frequency adjustments to the resultant shape of the beam as transmitted by this minimal array.

Figure 7:
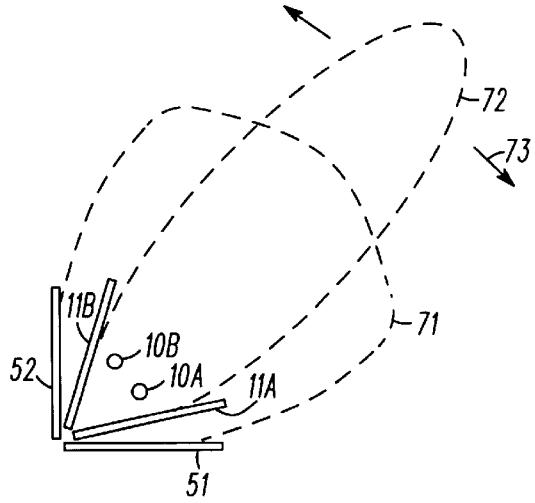
FIG. 7 depicts an embodiment of multiple antennas and electrochromic surfaces as configured in accordance with an embodiment of the invention.

FIG. 7 comprises a combination of the embodiments described above with respect to FIG. 6 and FIG. 5. In this embodiment, course beam shaping is conducted by controlling the opacity of the inner electrochromic surfaces 11A and 11B. With both inner surfaces 11A and 11B substantially transparent to the radio frequency energy, a relatively wide-lobed beam 71 will tend to result. Conversely, when both inner surfaces 11A and 11B are substantially opaque to the radio frequency energy, a relatively narrower and longer beam (i.e., higher gain) 72 will tend to result. (Other coarsely defined beams can be formed by rendering one, but not both, of the inner surfaces 11A and 11B substantially opaque.) In either case, the resultant beam can be further more finely shaped (or moved) by phased array techniques as well understood in the art and as represented in FIG. 7 by reference numeral 73.

Figure 8:
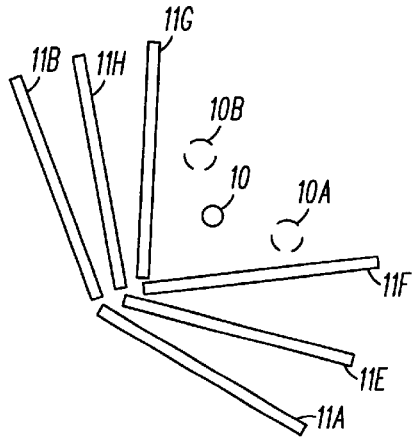
FIG. 8 depicts another embodiment of multiple antennas and electrochromic surfaces as configured in accordance with an embodiment of the invention.

Other permutations and combinations are of course possible. For example, with reference to FIG. 8, six electrochromic surfaces 11A, 11B, 11E, 11F, 11G, and 11H can be used with one antenna 10, two antennas 10A and 10B, or more to provide a wide variety of possible reflective surface combinations. Each such combination, of course, has a corresponding beam shape and direction. Such flexibility is presently virtually unheard of, as the cost and maintenance issues likely represented by achieving such capability through mechanical means would be considerable.

Figure 9:
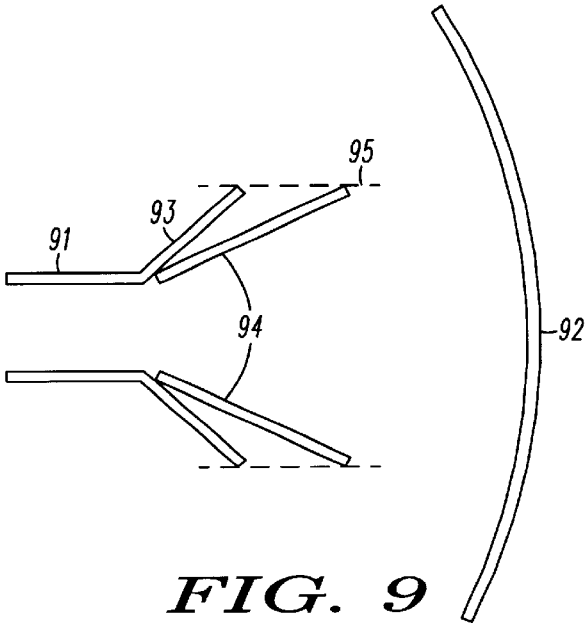
FIG. 9 depicts a parabolic reflector and feedhorn as configured in accordance with an embodiment of the invention.

The embodiments described above comprise monopole and/or dipole antennas used in conjunction with one or more electrochromatic surfaces that are selectively used as reflectors to control directionality and/or beam shape. The present invention finds expression through other embodiments as well, however. For example, and referring now to FIG. 9, an antenna comprising a parabolic reflector 92 and a feedhorn 91 can benefit as well. The feedhorn 91 is comprised of conductive material (or nonconductive material having a conductive surface disposed thereon) and includes an aperture formed from inclined surfaces 93 as well understood in the art. In this embodiment, the feedhorn 91 further includes additional inclined surfaces 94 that are formed using electrochromic surfaces as described above. These electrochromic surfaces 94 are more gently inclined than the other inclined surfaces 93 of the feedhorn 91 but, in this embodiment, extend out to a distance sufficient to ensure an aperture 95 that is substantially equivalent to the original aperture of the feedhorn 91. With a same sized aperture, the feedhorn 91 will exhibit essentially the same gain regardless of whether the electrochromatic surfaces 94 are render opaque or not. But varying the transparency of the electrochromatic surfaces 94, however, one can selectively vary the phase taper of the feedhorn 91. This capability can be used in various applications in various ways as desired.

Figure 10:
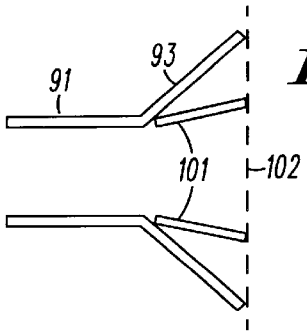
FIG. 10 depicts another embodiment of a feedhorn as configured in accordance with an embodiment of the invention.

With reference to FIG. 10, and referring now to an alternative embodiment, the electrochromic surfaces 101, while still inclined less sharply than the original inclined surfaces 93 of the feedhorn 91, extend only so far as the original aperture boundary 102. So configured, the resultant aperture that occurs when the electrochromatic surfaces 101 are rendered less transparent will be smaller than the original aperture of the feedhorn 91. As a result, the gain of the feedhorn 91 will be altered.

It would be possible, of course, to combine the above described embodiments to yield a feedhorn having both gain and phase taper that could be selectively varied by appropriate control of the electrochromatic surfaces. Such capabilities are beyond any present commercially feasible suggestions as found in the prior art.

Figure 11:
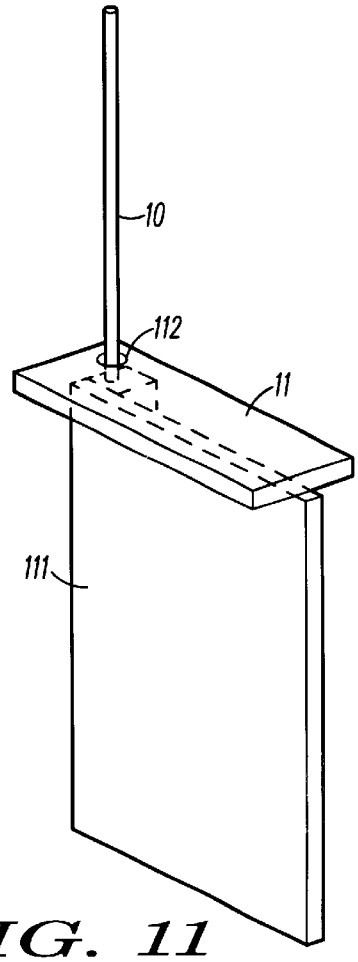
FIG. 11 depicts a perspective view of illustrative components of a handheld radio as configured in accordance with an embodiment of the invention.

Yet another application of these inventive concepts is illustrated in FIG. 11. FIG. 11 diagramatically depicts a printed wiring board 111 of a device such as a handheld two-way radio communications device (such as a cellular telephone-or a two-way dispatch communications unit) and a monopole antenna 10 as attached thereto. In such a configuration, and as well understood in the art, the printed wiring board 111 will act as an counterpoise to the antenna 10. When designing and manufacturing a device such as this, it is important that the antenna and counterpoise function at some useful point of equilibrium. Tuning and calibrating such a structure can, under some circumstances, be challenging and/or costly or time consuming. Pursuant to this embodiment, an electrochromic surface 11 is disposed substantially normal to the antenna 10 and the counterpoise/printed wiring board 111 (including, in this embodiment, a hole 112 disposed through the electrochromic surface 11 through which the antenna 10 passes). When transparent to the radiated energy, the electrochromatic surface 11 will not substantially impact performance of the device. By energizing the electrochromatic surface 11 to render it at least partially opaque to relevant frequencies of radiated energy, however, the electrochromatic surface 11 joins with the printed wiring board 111 as an effective counterpoise. If surface 11 and board 111 are electrically connected, they will function as one counterpoise. If surface 11 and board 111 are not electrically connected, board 111 will serve as the only counterpoise and surface 11 will constitute an independent reflector. Having these components electrically connected likely constitutes the simplest embodiment for facilitating entire impedance matching. Not having the electrical connection would, on the other hand, likely significantly complicate associated design considerations. These complications, however, might be offset in a given situation by the potential to achieve other design objectives. For example, a separate plate can offer either shielding, radio frequency re-radiation, or specific absorption rate options. Variable opacity/transparency in turn yields a variable counterpoise. This capability allows for tuning and calibration of the antenna and especially facilitates achieving a good impedance match vis a vis the effective counterpoise.

In a commercially feasible embodiment, the electrochromatic surface 11 in the above embodiment could be formed, for example, on an inside surface of the device housing. This could result in both a convenient form factor and further contribute to a reduced cost of implementation.

Figure 12:
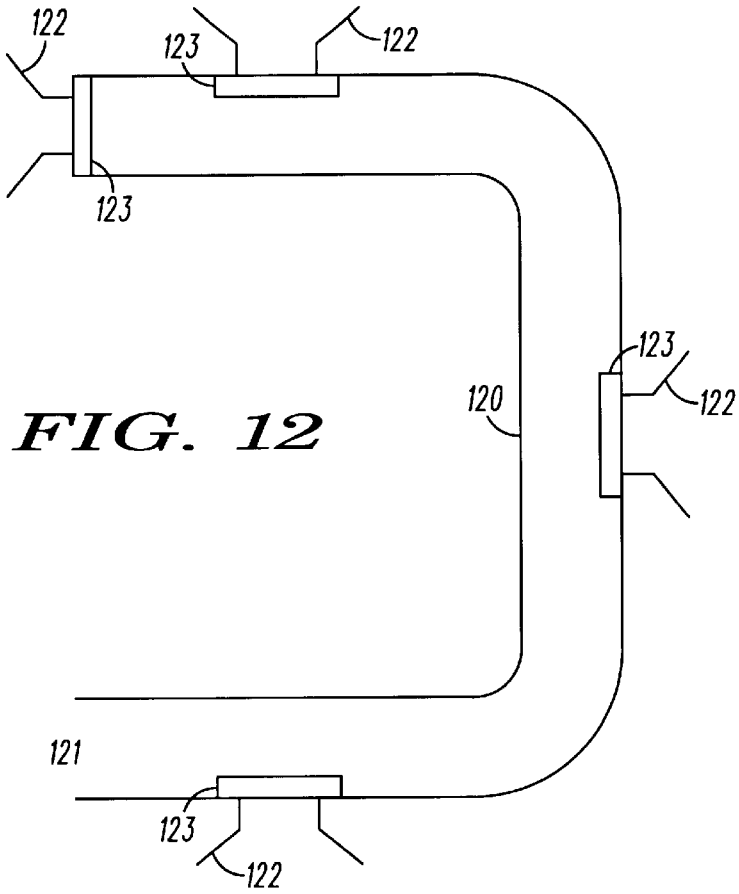
FIG. 12 depicts a top plan diagrammatic view of a waveguide as configured in accordance with an embodiment of the invention.

In yet another example of an application of these inventive principles, and referring now to FIG. 12, electrochromatic surfaces 123 can be used within a waveguide 120 to selectively attentuate passage of radiated energy as introduced through a waveguide opening 121 through various horn antennas 122. In particular, by rendering a given electrochromatic surface 123 as only partially opaque, some energy will be able to pass therethrough. Therefore, instead of merely functioning as an open-or-closed shutter, these surfaces can act as a valve to meter the passage of energy therethrough and to the corresponding horn antenna. And again, as with the embodiments above, these benefits are achieved without moving parts and the wear and tear and maintenance concerns that attend such an approach.

In all of the above embodiments, one or more electrochromic surfaces (formed on rigid or flexible carrier surfaces) are used in various ways with one or more radio frequency energy radiating elements and/or guiding elements to lend selective reflectivity to achieve greater resultant control over directionality, gain, phase, and/or shape of the radiated energy. These benefits are achieved with few or no moving parts and with a potential degree of high resolution control previously unattainable at any reasonable cost. Further, this technology holds great promise for high reliablity.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. An apparatus comprising:

an antenna;

at least one electrochromic surface disposed proximal to the antenna wherein the at least one electrochromic surface has at least one operational mode comprising energizing the at least one electrochromic surface to cause the at least one electrochromic surface to become reflective to at least some radio frequency energy emissions to thereby cause at least part of the radio frequency emissions from the antenna to be reflected in a direction and thereby contribute to at least one null or peak of a radio frequency beam in a selected direction.

2. The apparatus of claim 1 wherein the at least one electrochromic surface includes electrochromic material disposed on a flexible carrier.

3. The apparatus of claim 2 wherein the flexible carrier is comprised of thin flexible plastic.

4. The apparatus of claim 3 wherein the thin flexible plastic is disposed over another surface such that the at least one electrochromic surface comprises a dielectric antenna reflector.

5. The apparatus of claim 1 wherein the at least one electrochromic surface includes electrochromic material disposed on a substantially inflexible carrier.

6. The apparatus of claim 1 wherein the electrochromic surface selectively has at least two operational modes, comprising:

a first mode wherein the electrochromic surface is substantial transparent to radio frequency radiation from the antenna; and a second mode wherein the electrochromic surface is at least substantially reflective of at least some incident radio frequency radiation from the antenna.

7. The apparatus of claim 6 and further comprising at least one of the electrochromic surfaces disposed proximal to the antenna.

8. The apparatus of claim 1 wherein radio frequency energy as emitted by the antenna is directed substantially away from the at least one electrochromic surface.

9. The apparatus of claim 1 wherein the at least one electrochromic surface is comprised of a doped conjugated polymer.

10. The apparatus of claim 9 wherein the doped conjugated polymer includes polyaniline doped with camphorsulfonic acid.

11. The apparatus of claim 10 wherein the doped conjugated polymer further includes a source of cations.

12. The apparatus of claim 11 wherein the source of cations comprises at least one of sodium, potassium, and lithium.

13. The apparatus of claim 1 wherein the at least one electrochromic surface is comprised of an oxide.

14. The apparatus of claim 13 wherein the oxide comprises an oxide of at least one of tungsten, molybdenum, and niobium.

15. The apparatus of claim 14 wherein the at least one electrochromic surface is further comprised of a source of cations.

16. The apparatus of claim 15 wherein the source of cations includes at least one of sodium, potassium, and lithium.

17. The apparatus of claim 1 wherein providing at least one electrochromic surface includes providing a surface that is substantially transparent to visible light.

18. The apparatus of claim 17 wherein the electrochromic surface that is substantially transparent to visible light includes indium tin oxide electrodes.

19. The apparatus of claim 1 and further comprising at least a second antenna disposed proximal to the at least one electrochromic surface.

20. The apparatus of claim 19 and further comprising a phasing directional antenna pattern controller operably coupled to the antenna and at least the second antenna.

21. The apparatus of claim 20 wherein the apparatus comprises a phased array beam-steerable antenna system.

22. The apparatus of claim 1 wherein the antenna comprises a parabolic surface and the at least one electrochromic surface comprises a part of a feedhorn disposed proximal to the parabolic surface.

23. The apparatus of claim 22 wherein a beam width as associated with the feedhorn varies dynamically at least in part as a function of the at least one electrochromic surface.

24. The apparatus of claim 22 wherein a phase taper as associated with the feedhorn varies dynamically at least in part as a function of the at least one electrochromic device.

25. The apparatus of claim 1 wherein the antenna comprises a monopole antenna.

26. The apparatus of claim 1 and further comprising a radio and counterpoise that are operably coupled to the antenna.

27. The method of claim 26 wherein the at least one electrochromic surface is disposed between the antenna and a counterpoise.

28. A method comprising:

providing an antenna;

sourcing radio frequency emissions at least in part using the antenna;

providing at least one electrochromic surface disposed proximal to the antenna;

energizing the at least one electrochromic surface to cause the at least one electrochromic surface to become reflective to at least some radio frequency energy emissions to thereby cause at least part of the radio frequency emissions from the antenna to be reflected in a direction and thereby contribute to at least one null or peak of a radio frequency beam in a selected direction.

29. The method of claim 28 wherein providing at least one electrochromic surface includes providing at least one electrochromic surface comprised at least in part of polyaniline material.

30. The method of claim 28 wherein providing at least one electrochromic surface includes providing at least one electrochromic surface comprised at least in part of a doped conjugated polymer.

31. The method of claim 30 wherein providing at least one electrochromic surface comprised at least in part of a doped conjugated polymer includes providing at least one electrochromic surface comprised at least in part of a polyaniline doped with camphorsulfonic acid.

32. The method of claim 31 wherein providing at least one electrochromic surface includes providing at least one electrochromic surface that includes a source of cations.

33. The method of claim 32 wherein providing at least one electrochromic surface that includes a source of cations includes providing at least one electrochromic surface that includes a source of cations such as at least one of sodium, potassium, and lithium.

34. The method of claim 28 wherein providing at least one electrochromic surface includes providing at least one electrochromic surface comprised at least in part of:

an oxide of at least one of tungsten, molybdenum, and niobium, and a source of cations such as sodium, potassium, and lithium.

35. The apparatus of claim 28 wherein providing at least one electrochromic surface includes providing a substantially transparent electrochromic surface that includes indium tin oxide electrodes.

36. The method of claim 28 and further comprising at least a second electrochromic surface disposed proximal to the antenna.

37. The method of claim 36 and further comprising energizing the at least a second electrochromic surface to cause the at least one electrochromic surface to become reflective to at least some radio frequency energy emissions to thereby cause at least part of the radio frequency emissions from the antenna to be reflected in a direction and thereby contribute to at least one null or peak of a radio frequency beam in a selected direction.

38. The method of claim 28 and further comprising providing at least a second antenna disposed proximal to the at least one electrochromic surface.

39. The method of claim 38 and further comprising providing upmixed phase/magnitude/time controlled baseband signals and using both the at least one electrochromic surface and the upmixed phase/magnitude/time controlled baseband signals to control the beam.

40. The method of claim 38 and further comprising more narrowly defining the radio frequency beam using phasing.

41. A method comprising:

providing an antenna;

sourcing radio frequency emissions at least in part using the antenna;

providing a plurality of electrochromic surfaces disposed proximal to the antenna; selectively energizing at least one of the electrochromic surfaces to cause the at least one electrochromic surface to become reflective to at least some radio frequency energy emissions to thereby cause at least part of the radio frequency emissions from the antenna to be reflected in a direction and thereby contribute to a radio frequency beam directed in a direction and thereby contribute to at least one null or peak of a radio frequency beam in a selected direction.

42. The method of claim 41 and further comprising providing a plurality of antennas and sourcing the radio frequency emissions at least in part using the plurality of antennas.

43. The method of claim 41 and further comprising providing upmixed phase/magnitude/time controlled baseband signals and using both the at least one electrochromic surface and the upmixed phase/magnitude/time controlled baseband signals to control the beam.

44. The method of claim 41 wherein the radio frequency beam is directed in a general direction using the electrochromic surfaces and in a more specific direction using phasing as between the plurality of antennas.

45. An apparatus comprising:

an antenna;

at least one electrochromic surface disposed proximal to the antenna, wherein at least one of electromagnetic field energy gain and phase as radiated by the antenna is influenced by the at least one electrochromic surface.

46. A waveguide system having a plurality of variable amplitude/phase controlling devices each comprising at least one electrochromic surface, wherein at least one of the electrochromic surfaces is operably controlled by a number of discrete bias voltages greater than two.

47. A method comprising:

providing a monopole antenna;

providing at least one electrochromic surface disposed proximal to the monopole antenna.

48. The method of claim 47 and further comprising using the at least one electrochromic surface as part of a counterpoise when tuning an impedance match with the antenna.

49. The method of claim 48 and further comprising tuning a center frequency of the antenna by selective activation of the at least one electrochromic surface.

* * * * *